US011441445B2

(12) United States Patent
Xu et al.

(10) Patent No.: US 11,441,445 B2
(45) Date of Patent: Sep. 13, 2022

(54) PNEUMATIC DEVICE

(71) Applicant: TRANF TECHNOLOGY (XIAMEN) CO., LTD., Xiamen (CN)

(72) Inventors: Shuidian Xu, Xiamen (CN); Yanfu Li, Xiamen (CN); Tao Xu, Xiamen (CN)

(73) Assignee: TRANF TECHNOLOGY (XIAMEN) CO., LTD., Xiamen (CN)

( * ) Notice: Subject to any disclaimer, the term of this patent is extended or adjusted under 35 U.S.C. 154(b) by 0 days.

(21) Appl. No.: 17/125,784

(22) Filed: Dec. 17, 2020

(65) Prior Publication Data

US 2021/0115810 A1 Apr. 22, 2021

Related U.S. Application Data

(63) Continuation of application No. PCT/CN2019/096484, filed on Jul. 18, 2019.

(30) Foreign Application Priority Data

Aug. 19, 2018 (CN) ..... 201810944526.3

(51) Int. Cl.
*F01D 1/02* (2006.01)
*F01D 1/34* (2006.01)
*F01D 25/00* (2006.01)

(52) U.S. Cl.
CPC ..... *F01D 25/00* (2013.01); *F01D 1/02* (2013.01); *F01D 1/34* (2013.01); *F05D 2200/23* (2013.01)

(58) Field of Classification Search
CPC . F01D 1/02; F01D 1/023; F01D 1/026; F01D 1/22; F01D 1/32; F01D 1/34;
(Continued)

(56) References Cited

U.S. PATENT DOCUMENTS 111,538 A * 2/1871 Herron ..... F01D 1/32 415/63
925,127 A * 6/1909 McDonald ..... F01D 1/32 415/63

(Continued)

FOREIGN PATENT DOCUMENTS

CN 107083994 A 8/2017
CN 206942813 U 1/2018

(Continued)

OTHER PUBLICATIONS

Machine translation of JP2005188378 A (Year: 2005).*

(Continued)

*Primary Examiner* — Christopher R Legendre
(74) *Attorney, Agent, or Firm* — J.C. Patents

(57) ABSTRACT

A pneumatic device includes an outer ring (1) and a core body (3), at least one stage of secondary stroke flow channel (300) being provided between a nozzle (301) and an exhaust port (302) which are located at an outer ring surface of the core body (3); gas enters from an intake passage (31), is ejected in stages through the nozzle (301) and the secondary stroke flow channel (300) of the core body (3), acts on at least two driving recesses (11) in a circumferential direction of the outer ring (1), and generates a pushing force for the driving recesses (11) to push the outer ring (1) to rotate and do work, so as to achieve a power output, and finally, the gas is discharged from an exhaust passage (310) through the exhaust port (302) of the core body (3).

13 Claims, 7 Drawing Sheets

(58) Field of Classification Search
CPC ..... F01D 1/36; F01D 1/38; F01D 5/03; F03B 1/00; F05D 2200/23
See application file for complete search history.

(56) References Cited

U.S. PATENT DOCUMENTS

| | | | | |
|---|---|---|---|---|
| 948,692 | A * | 2/1910 | Dodd | F01D 1/026 415/57.4 |
| 1,349,487 | A * | 8/1920 | Bennett | F01D 1/026 415/57.3 |
| 3,026,088 | A | 3/1962 | Green | |
| 8,678,749 | B2 | 3/2014 | Saitoh | |
| 2011/0164958 | A1 | 7/2011 | Saitoh | |
| 2020/0088035 | A1* | 3/2020 | Xu | F01B 17/02 |
| 2021/0115810 | A1* | 4/2021 | Xu | F01D 1/02 |

FOREIGN PATENT DOCUMENTS

| | | | | |
|---|---|---|---|---|
| CN | 208929795 | U | 6/2019 | |
| CN | 208940384 | U | 6/2019 | |
| CN | 208944378 | U | 6/2019 | |
| CN | 208946090 | U | 6/2019 | |
| CN | 208947094 | U | 6/2019 | |
| CN | 208950593 | U | 6/2019 | |
| CN | 208950763 | U | 6/2019 | |
| CN | 208950764 | U | 6/2019 | |
| CN | 209176502 | U | 7/2019 | |
| CN | 209176503 | U | 7/2019 | |
| CN | 209179821 | U | 7/2019 | |
| CN | 209179936 | U | 7/2019 | |
| JP | 2005188378 | A | 7/2005 | |
| JP | 2006144720 | | 6/2006 | |
| RU | 148081 | U1 | 11/2014 | |
| WO | WO-0029721 | A1 * | 5/2000 | F01D 15/10 |

OTHER PUBLICATIONS

International Search Report of PCT/CN2019/096484.
The Notice of Allowance of RU application No. 2020142338.
Office Action of the parallel JP application.
Office Action of the parallel application IN202047055778.

* cited by examiner

PNEUMATIC DEVICE

CROSS-REFERENCE TO RELATED APPLICATIONS

This application is a continuation of International Application No. PCT/CN2019/096484, filed on Jul. 18, 2019, which claims priority to Chinese Patent Application No. 201810944526.3, filed on Aug. 19, 2018, both of which are hereby incorporated by reference in their entireties.

TECHNICAL FIELD

The present disclosure discloses a pneumatic device, belonging to the technical field of mechanical devices for generating power according to the International Patent Classification (IPC).

BACKGROUND

The original meaning of an engine refers to a "mechanical device that generates power", which is a machine that converts a certain form of energy into mechanical energy, for example, the chemical energy of liquid or gas combustion is converted into heat energy through combustion, and then the heat energy is converted to mechanical energy through expansion and outputs power to the outside. A current research direction of engines, especially pneumatic engines, is to develop compact, efficient and reliable small engines, most of which are in an experimental phase, i.e., trial production phase, and there are no large-scale commercial applications.

At present, design prototypes of most of gas engines are based on piston engines or vane pumps, to realize energy conversion by heating a heat exchanger so as to achieve a power output, but they have complex structures and low efficiency, which is difficult to meet requirements of endurance capacity.

The Chinese patent literature (CN201410167469.4) discloses a variable pressure jet air engine, including an impeller chamber and an impeller, the impeller chamber is provided with an injection port for injecting a compressed gas and an exhaust port for ejecting the compressed gas, the impeller is installed in the impeller chamber through a rotating shaft, the impeller includes blade teeth equally divided along a rotating circumferential surface; and the rotating circumferential surface of the impeller matches an inner surface of the impeller chamber with an air gap, and the inner surface of the impeller chamber is also provided with a variable pressure gas jet groove. The structure disclosed in the literature is similar to that of a vane pump, the setting of the variable pressure gas jet groove results in low rotation speed and low efficiency of the engine.

The Chinese patent literature (CN107083994A) discloses a pneumatic engine, which is an invention of an air engine proposed by the inventor of the present case, the air is ejected through an intake flow channel for directly driving a motor core and acts on a surface of a groove of an outer ring to generate a pushing force to push the outer ring to rotate, which is a major disruptive change in the field of engine, and its output torque can match with an existing car engine, and its equivalent endurance mileage is equivalent to the endurance mileage of current similar type of new energy vehicles.

In order to further improve the performance of the engine and realize a compact, efficient and reliable gas power generating device, the inventors have gone through years of development and research, and thus propose the present disclosure.

SUMMARY

In view of the shortcomings in the prior art, the present disclosure provides a pneumatic device, where energy of gas is used repeatedly through multi-stage flow channels on a core body in a circumferential direction, and output of power is realized by the core body driving an outer ring to rotate. The pneumatic device has advantages of compact structure, large torque, high rotation speed, high transmission efficiency, energy conservation and environmental protection, etc.

In order to achieve the above objectives, the present disclosure is achieved by the following technical solution:

a pneumatic device, including:

an outer ring, having a plurality of driving recesses on an inner ring surface of the outer ring in a circumferential direction;

a core body, being coaxially arranged in the outer ring and being capable of rotating relative to the outer ring, where an outer ring surface of the core body is provided with at least one nozzle, at least one exhaust port, and at least one secondary stroke flow channel between the nozzle and the exhaust port;

at least one intake passage, communicating with the at least one nozzle; and at least one exhaust passage, communicating with the at least one exhaust port;

a gas enters from the intake passage, is ejected in stages through the nozzle of the core body and the secondary stroke flow channel, acts on at least two driving recesses of the outer ring in the circumferential direction, and generates a pushing force for the driving recesses to push the outer ring to rotate and do work, so as to achieve a power output, and finally, the gas is discharged from the exhaust passage through the exhaust port of the core body.

Further, at least one intake passage, at least one nozzle, at least two driving recesses, at least one secondary stroke flow channel, at least one exhaust port and at least one exhaust passage form an independent work unit, and the pneumatic device includes at least one independent work unit.

Further, the nozzle and the secondary stroke flow channel on the core body communicate with a corresponding driving recess of the outer ring, at least one secondary stroke flow channel and corresponding driving recesses are arranged alternately and sequentially communicated, and the secondary stroke flow channel is arranged along the core body or the outer ring in the circumferential direction.

Further, the intake passage and the exhaust passage are formed inside the core body.

Further, the core body includes:

the intake passage, forming the nozzle on a peripheral surface of the core body, where a running direction of the intake passage is an arc line extending from a middle to an outside, and the nozzle communicates with a corresponding driving recess of the outer ring to form a first stage flow channel; and the secondary stroke flow channel, a running direction of which is an arc line extending inward from an edge of the core body and then curved toward the edge, where each secondary stroke flow channel communicates with corresponding two driving recesses, i.e., front and rear driving recesses, of the outer ring and forms a N-stage flow channel along the circumferential direction of the core body, where N is a natural number greater than or equal to 2;

each stage flow channel operates with a corresponding driving recess of the outer ring to form a multi-stage stroke structure with decreasing gas energy.

Further, the secondary stroke flow channel includes a return channel and a stroke channel communicated with the return channel, the return channel communicates with a corresponding driving recess of the outer ring, and the stroke channel communicates with another driving recess.

Further, a running direction of the intake passage of the core body is a logarithmic spiral line extending from a middle to an outside, and a pole of the logarithmic spiral line is set on a central axis line of the core body, and a strike angle of the logarithmic spiral line is 15°-45°.

Further, the core body is provided with the intake passage, a running direction of the intake passage is the logarithmic spiral line extending from the middle to the outside, a running direction of the stroke channel of the secondary stroke flow channel is a logarithmic spiral line, and the running direction of the logarithmic spiral line of the stroke channel of the secondary stroke flow channel is roughly the same as the running direction of the logarithmic spiral line of the intake passage.

Further, the pneumatic device further includes a shaft, and the outer ring and the core body are coaxially arranged on the shaft.

Further, the pneumatic device further includes the shaft, the outer ring and the core body are coaxially arranged on the shaft, and the shaft is provided with an intake shaft passage and an exhaust shaft passage, which are in communication with the intake passage and the exhaust passage of the core body, respectively.

The intake shaft passage and the exhaust shaft passage in the shaft are provided with an inlet and an outlet, and the intake shaft passage and the exhaust shaft passage are not communicated.

Further, the outer ring matches with the shaft through side plates to form a closed space, and the core body is arranged in the closed space and connected and fixed with the shaft.

Further, the intake passage, the nozzle, the driving recesses, the secondary stroke flow channel, the exhaust port and the exhaust passage in the independent work unit form a gas flowing path.

Further, the pneumatic device includes two or more independent work units to form a multi-stage driving structure, which is arranged along the core body or the outer ring in the circumferential direction.

Further, the inner ring surface of the outer ring is provided with two or more driving recesses, and each driving recess has a contour bottom surface and a driving surface, a contour line of the contour bottom surface is a logarithmic spiral line, and a pole of the logarithmic spiral line is set at a center of the core body.

A pneumatic engine includes the pneumatic device, and the gas for pneumatic engine is a compressed gas or a gas with a certain pressure. A continuously variable transmission includes the pneumatic device.

The pneumatic device of the present disclosure has a simple structure, a large torque, a high rotation speed, a high transmission efficiency, and a low energy consumption, it can be widely used in vehicles, power generation equipment and other fields that require power output devices, the present disclosure has the following beneficial effects:

1. In the present disclosure, the core body is provided with a multi-stage flow channel, that is, the intake passage as the first stage flow channel, each secondary stroke flow channels as second, third, fourth . . . stage flow channels, gas acts on one driving recess of the outer ring by the first stage flow channel, the driving recesses communicate with the second stage flow channel, and then the gas returns to the second stage flow channel and then acts on another driving access of the outer ring, . . . and so on, until the gas is discharged from the exhaust passage. The whole process proceeds in the forward direction along the rotation direction of the outer ring, has a large torque, a high transmission efficiency, and high gas utilization rate, and the output torque further increases as the rotation speed increases.

2. Flow channels are arranged in the circumferential direction of the core body of the present disclosure, they effectively reduce the volume of the overall device and can be flexibly matched to power generation or output equipment in various fields; at the same time, the more the intake flow channels on the core body, the overall weight of the device is reduced, which further improves the output speed and efficiency of the device.

DETAILED DESCRIPTION OF THE EMBODIMENTS

Figure 1:
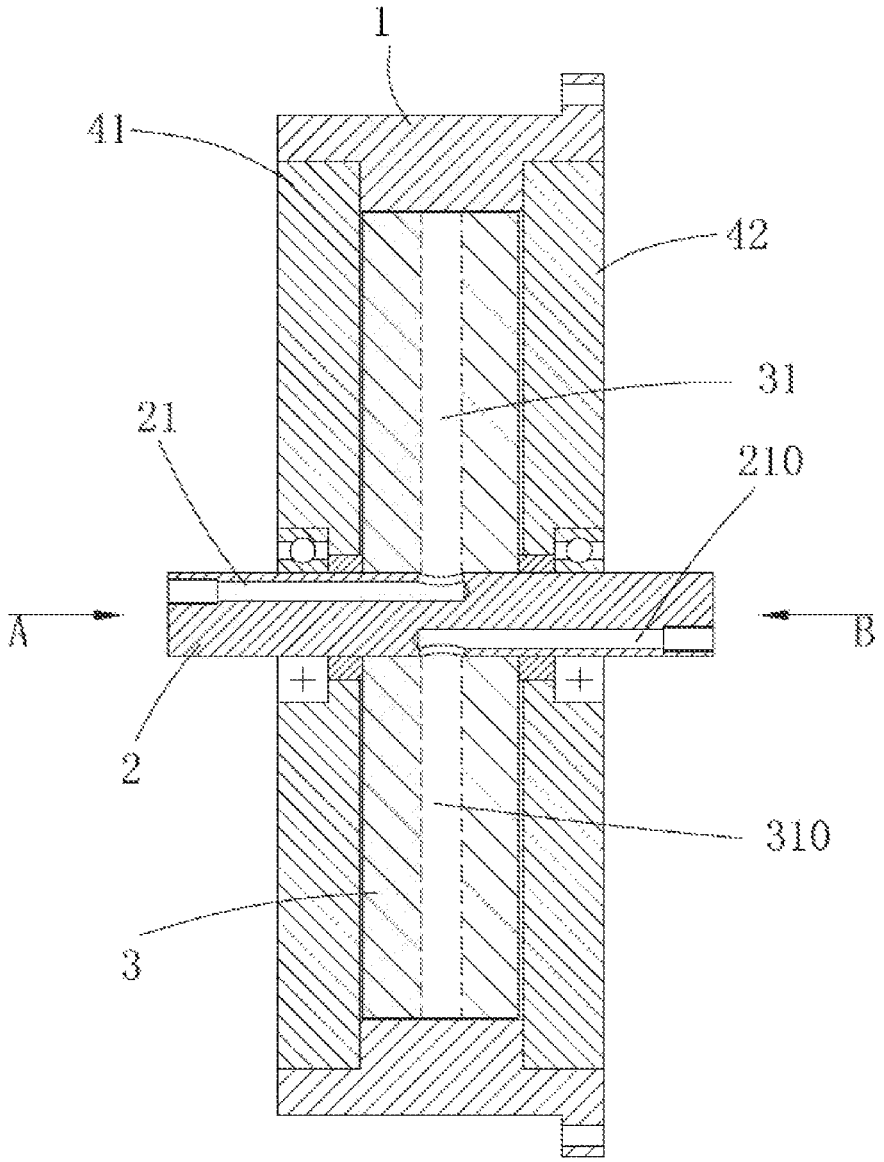
FIG. 1 is a schematic diagram of Embodiment 1 of the present disclosure.

The present disclosure will be further explained below in conjunction with drawings.

Embodiment 1

Please refer to FIGS. 1 to 4, a pneumatic device includes an outer ring 1, having a plurality of driving recesses 11 on an inner ring surface of the outer ring in a circumferential direction; a core body 3, being coaxially arranged in the outer ring 1 and being capable of rotating relative to the outer ring, where an outer ring surface of the core body 3 is provided with at least one nozzle 301, at least one exhaust port 302, and at least one secondary stroke flow channel 300 between the nozzle and the exhaust port;

at least one intake passage 31, communicating with the at least one nozzle 301; and at least one exhaust passage 310, communicating with the at least one exhaust port 302;

a gas enters from the intake passage 31, is ejected in stages through the nozzle 301 and the secondary stroke flow channel 300 of the core body 3, acts on at least two driving recesses 11 of the outer ring in the circumferential direction, and generates a pushing force for the driving recesses to push the outer ring 1 to rotate and do work, so as to achieve a continuous power output, and finally, the gas is discharged from the exhaust passage through the exhaust port of the core body 3. The pneumatic device further includes a shaft 2, and the outer ring 1 and the core body 3 are coaxially arranged in the shaft 2.

Figure 4:
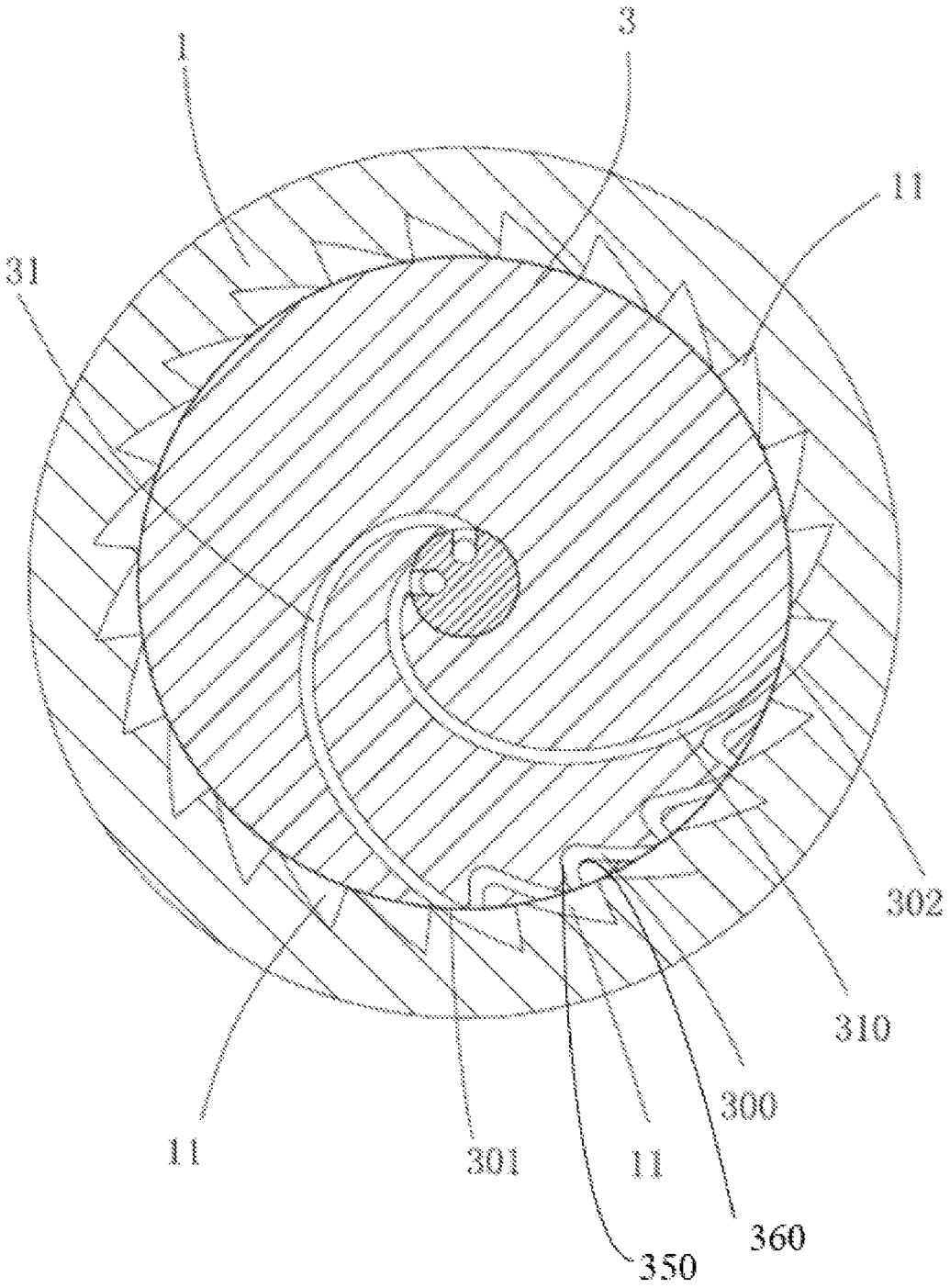
FIG. 4 is a cross-sectional view of Embodiment 1 of the present disclosure.

As shown in FIG. 4, the intake passage 31 and the exhaust passage 310 are formed inside the core body 3. The nozzle 301 and the secondary stroke flow channel 300 on the core body 3 communicate with the driving recesses 11 corresponding to the outer ring 1, where at least one secondary stroke flow channel 300 and corresponding driving recesses 11 are arranged alternately and sequentially communicated, and the secondary stroke flow channel 300 are arranged along the core body or the outer ring in the circumferential direction.

As shown in FIG. 4, the core body 3 includes: the intake passage 31, forming a nozzle 31 on the peripheral surface of the core body, and running in a direction that is an arc line extending from middle to outside, where the nozzle 301 communicates with a corresponding driving recess 11 of the outer ring to form a first stage flow channel;

the secondary stroke flow channel 300, running in a direction that is an arc line extending inward form an edge of the core body 3 and then curved toward the edge, each secondary stroke flow channel 300 communicates with corresponding two driving recesses, i.e., front and rear driving recesses, of the outer ring 1, forming N-stage flow channels along the circumferential direction of the core body, where N is an natural number greater than or equal to 2. It need to be noted that, if it is a two-stage flow channel, then it includes a first stage flow channel (intake passage) and a second stage flow channel (secondary stroke flow channel); if it is a three-stage flow channel, then it includes a first stage flow channel (intake passage), a second stage flow channel (secondary stroke flow channel), a third stage flow channel (another secondary flow channel), . . . .

Each stage flow channel cooperates with corresponding driving recesses of the outer ring to form a multi-stage stroke structure with decreasing gas energy.

According to the requirement of the load, the pneumatic device can be designed, where the core body 3 can be set to be a two-stage flow channel, a three-stage flow channel, or more-stage intake flow channel; each stage does work circularly, makes full use of energy, and improve the use efficiency to the maximum extent to meet the needs of outputting torque and rotation speed.

Figure 5:
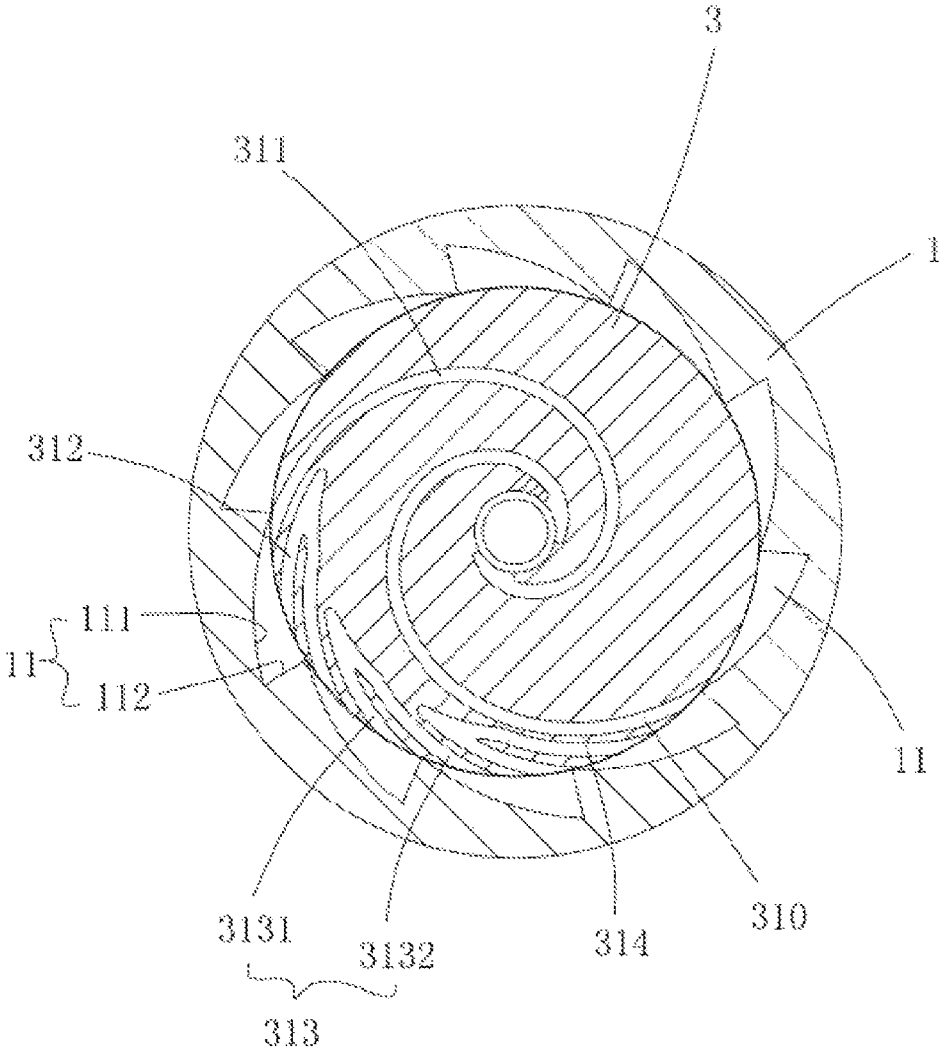
FIG. 5 is another layout diagram of Embodiment 1 of the present disclosure.

FIG. 5 is a schematic diagram of a four-stage flow channel. After entering from a first stage flow channel 311, a compressed gas passes through a second stage flow channel 312, a third stage flow channel 313, and a fourth stage flow channel 314, and is ejected and acts on corresponding driving recesses 11, and finally, is output through the exhaust passage 310; FIG. 4 is a schematic diagram of a five-stage intake flow channel, and the working process is similar to that shown in FIG. 5. As shown in FIG. 5, the secondary stroke flow channel 300 is delimited by a radially inner boundary 350 and a radially outer boundary 360, portions of which are radially spaced from the outer ring surface of the core body 3, and includes a return channel and a stroke channel in communication with the return channel, for example, the return channel 3131 and the communicated stroke channel 3132 in the third stage flow channel in FIG. 5, where the return channel 3131 communicates with a corresponding driving recess of the outer ring, and the stroke channel 3132 communicates with another driving recess.

Please refer to FIG. 1, the pneumatic device further includes a shaft 2, the outer ring 1 and the core body 3 are coaxially arranged on the shaft 2, the shaft 2 is provided with intake and exhaust shaft passages 21 and 210, they communicate with the intake passage 31 and the exhaust passage 310 of the core body 3, respectively. The intake and exhaust shaft passages in the shaft are provided with an inlet (gas inlet) and an outlet (gas outlet), and the intake and exhaust shaft passages are not communicated. The outer ring 1 matches with the shaft 2 through side plates 41 and 42 to form a closed space, and the core body 3 is arranged in the closed space and connected and fixed with the shaft 2. The core body 3 of the present disclosure is provided with at least two stages of flow channel, and each stage flow channel communicates with corresponding driving recesses of the outer ring, and finally, the gas is discharged from the exhaust passage.

Please refer to FIG. 1, the core body 3 of the present disclosure can be formed by a left core body and a right core body matching with each other, the matching surfaces of the left and right cores bodies are provided with an intake passage 31 and an exhaust passage 310, and the core body 3 can also be cast as a whole.

Please refer to FIG. 1 and FIG. 4, this embodiment is a primary driving structure. A gas passage is provided on the core body 3 along the circumferential direction to form the primary driving structure, and the gas passage is also called an independent work unit. On the core body 3 and the outer ring 1, one intake passage 31, one nozzle 301, at least two driving recesses 11, at least one secondary stroke flow channel 300, an exhaust port 302 and an exhaust passage 310 form an independent work unit. The pneumatic device includes at least one independent work unit. In the independent work unit, the intake passage 31, the nozzle 301, the driving recesses 11, the secondary stroke flow channel 300, the exhaust port 302 and the exhaust passage 310 form a gas flowing path.

Please refer to FIG. 1, FIG. 4 or FIG. 5, the inner ring surface of the outer ring 1 in the present disclosure is provided with two or more driving recesses 11, each driving recess has a contour bottom surface 111 and a driving surface 112, a contour line of the contour bottom surface 111 can be a common arc line or a spiral line; when the contour line of the contour bottom surface is a logarithmic spiral line, a pole of the contour bottom surface is set on the shaft 2, and each driving recess 11 communicates with two adjacent stage flow channels at the same time to allow the gas entering from a front stage flow channel to output from a back stage flow channel.

A running direction of the intake passage, i.e., the first stage flow channel, of the core body 3 of the present disclosure can be a common arc or spiral line, the running direction of stroke channel of each secondary stroke flow channel, i.e., the $N^{th}$ stage flow channel, can also be a common arc or spiral line.

As shown in FIG. 4 and FIG. 5, the core body 3 of the present disclosure is provided with an intake passage 31. A running direction of the intake passage 31 is a logarithmic spiral line extending from the middle to the outside, a running direction of the stroke channel of the secondary stroke flow channel 300 is a logarithmic spiral line, and the running direction of the logarithmic spiral line of the stroke channel of the secondary stroke flow channel is roughly the same as the running direction of the logarithmic spiral line of the intake passage. The running direction of the intake passage of the core body 3 is the logarithmic spiral line extending from the middle to the outside, and a pole of the logarithmic spiral line is set on a central axis line of the core body, and a strike angle of the logarithmic spiral line is 15°-45°, the smaller the angle, the longer the flow channel, the more loss; the larger the angle, the smaller the tangential force component that drives the outer ring.

Figure 2:
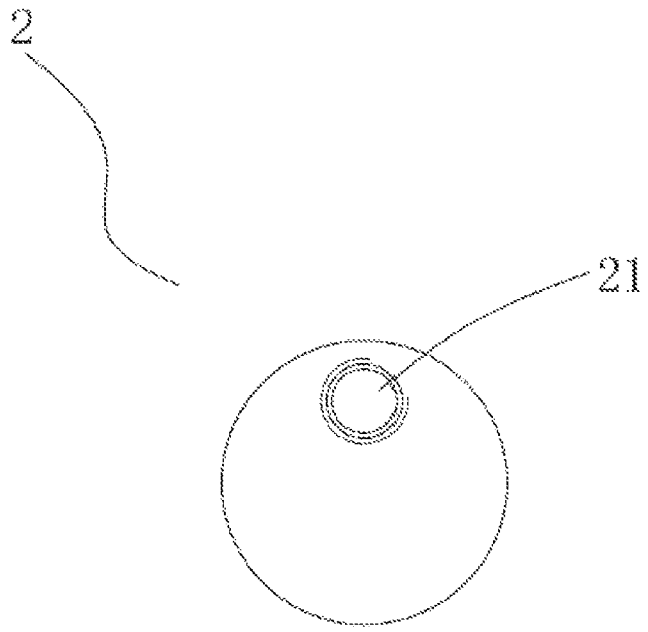
FIG. 2 is a side view of an axis from A direction according to Embodiment 1 of the present disclosure.
Figure 3:
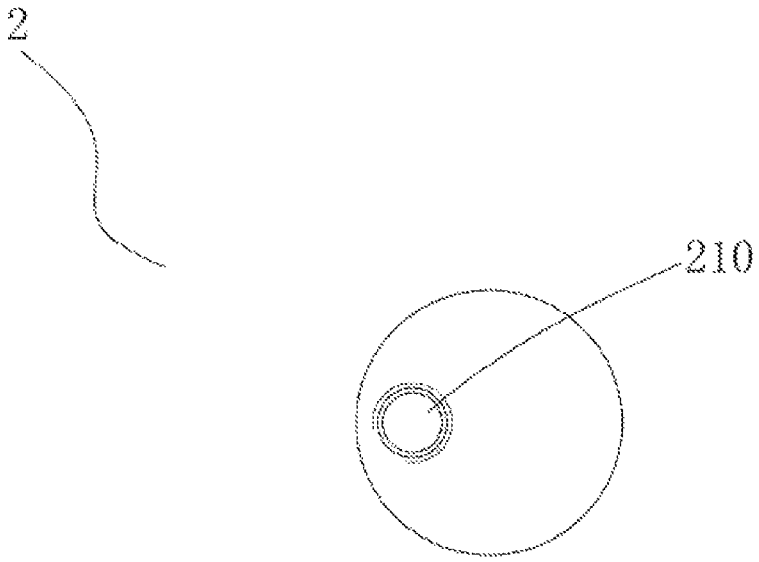
FIG. 3 is a side view of the axis from B direction according to Embodiment 1 of the present disclosure.

Please refer to FIG. 1, FIG. 2 and FIG. 3, the intake shaft passage 21 and the exhaust shaft passage 210 in the shaft 2 of the present disclosure form an inlet and an outlet, and the intake and exhaust shaft passages are not communicated. The inlet and outlet of the shaft can be arranged at one end of the shaft or at both ends of the shaft, the intake shaft passage 21 communicates with the intake passage 31 of the core body; the outlet of the shaft axially extends to form an exhaust shaft passage 210; and the exhaust shaft passage communicates with the exhaust passage 310 of the core body.

The pneumatic device involved in this application refers to a device that can convert gas energy into mechanical rotation. In addition to necessary designs on the outer ring, the core body and the corresponding recess structure or flow channel structure, the device may additionally include other components; for example, it may additionally include, for example, a housing and a sealing structure to provide protection, and for another example, it may additionally include a coupling to provide torque transmission, etc. Among them, a specific form of the outer ring can be changed according to different output modes of mechanical rotation, for example, an external tooth structure is formed on the outside of the outer ring to facilitate the output of kinetic energy through gear transmission; for another example, the outer ring has a belt groove to facilitate the output of the kinetic energy by belt transmission; for still another example, the outer ring has a mounting flange, so that the coupling can be conveniently installed to output kinetic energy; and so on. The core body and the outer ring are made of hard materials, which are not limited to metals, metal alloys, plastics, and composite materials. The recess structure or the flow channel structure of the core body and the outer ring can be processed by any known production methods, including but not limited to die casting, forging, extrusion, 3D printing, etc. The gas pressure input to the pneumatic device can be produced by a compressor (such as a pneumatic pump), or by a container for compressing a fluid (such as a high-pressure gas bottle), etc.

Figure 6:
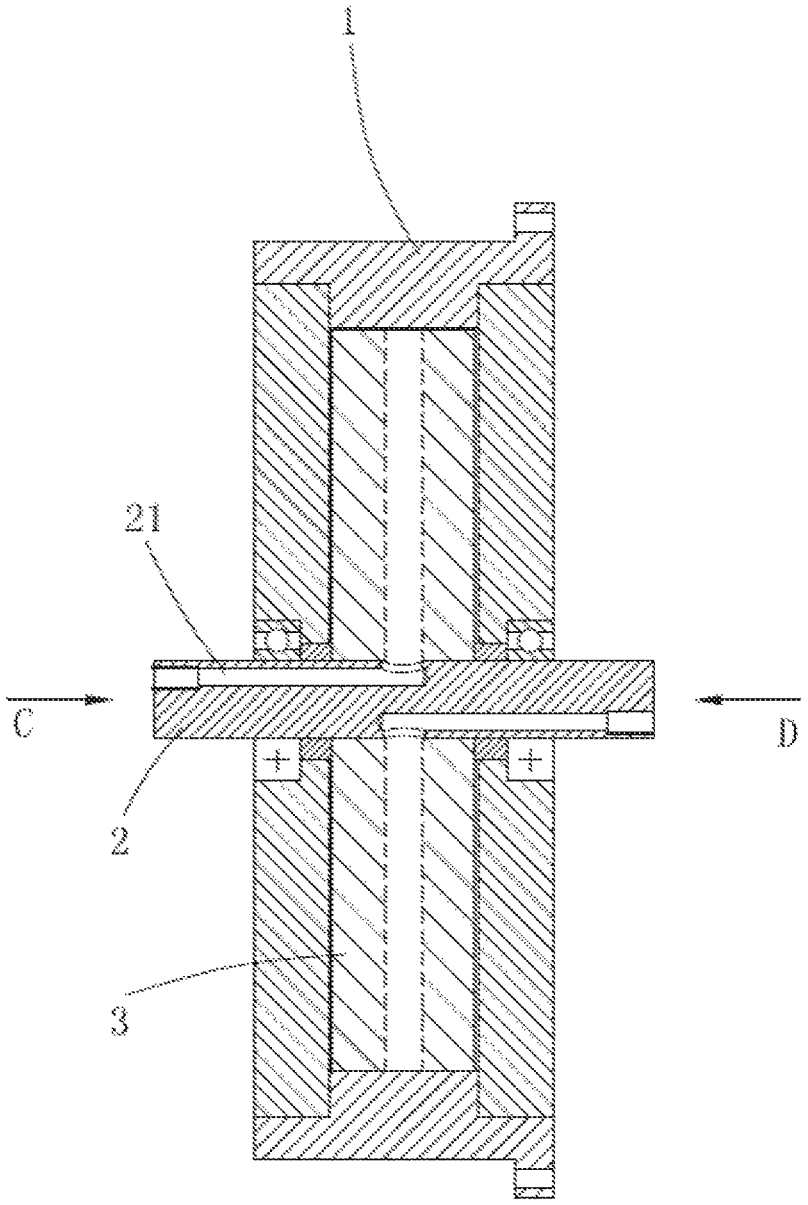
FIG. 6 is a schematic diagram of Embodiment 2 of the present disclosure.
Figure 7:
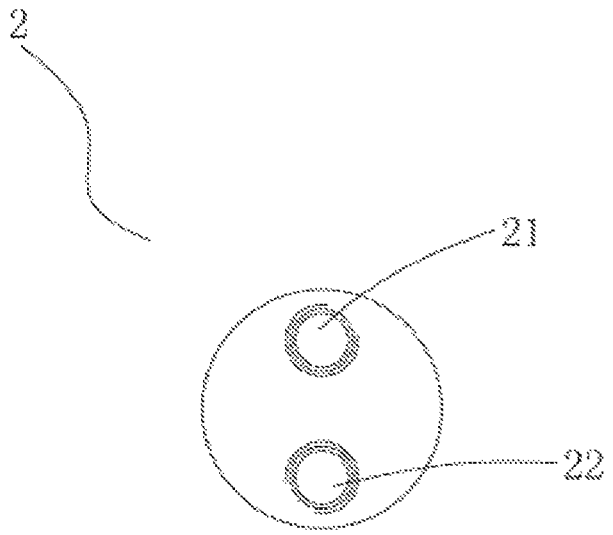
FIG. 7 is a side view of an axis from C direction according to Embodiment 2 of the present disclosure.
Figure 8:
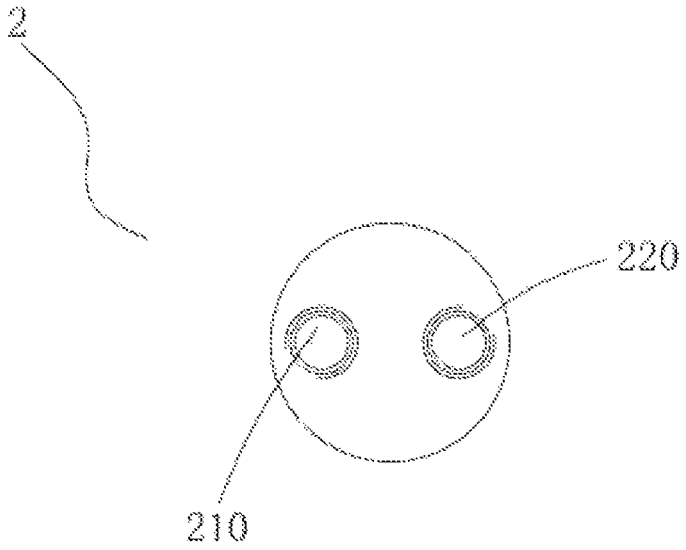
FIG. 8 is a side view of the axis from D direction according to Embodiment 2 of the present disclosure.
Figure 9:
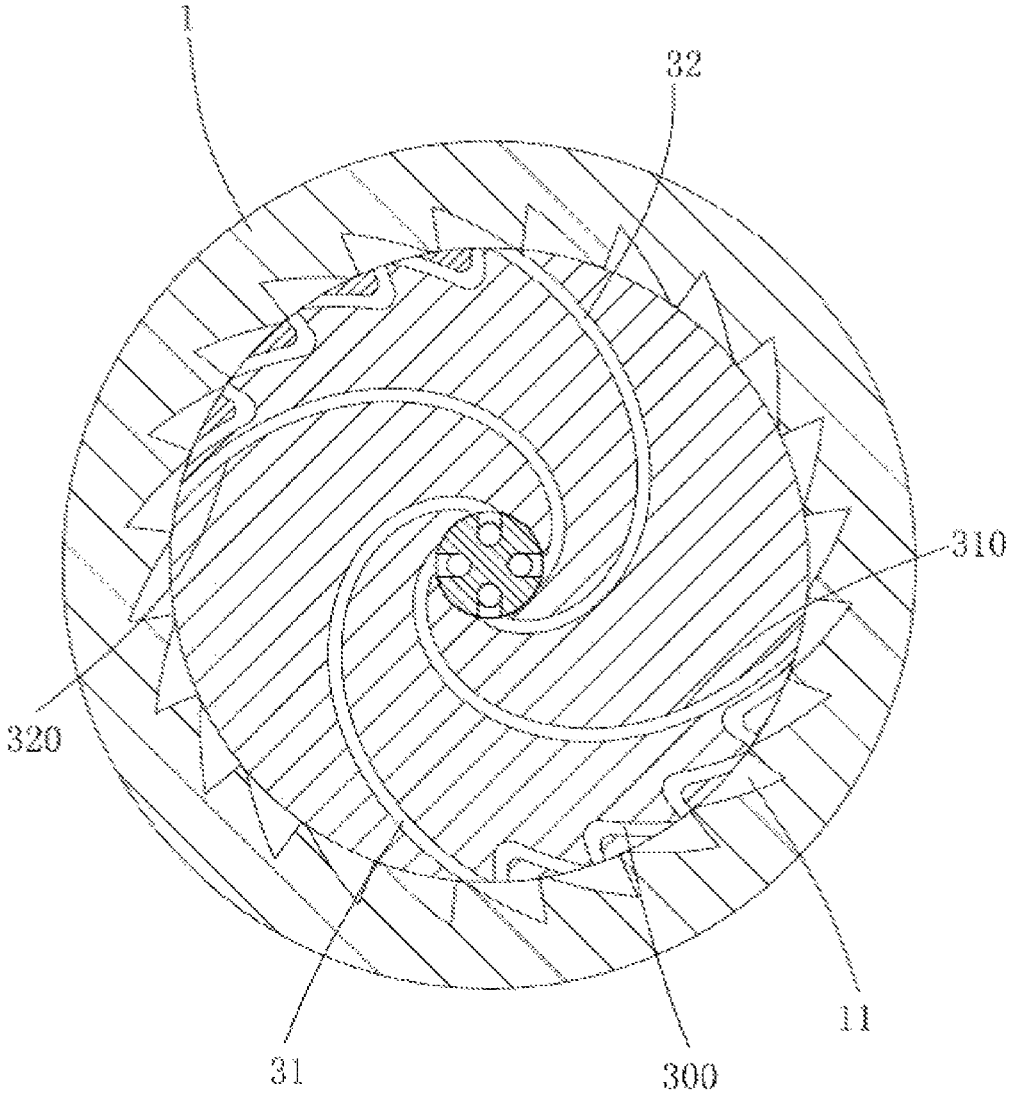
FIG. 9 is a radial sectional view of Embodiment 2 of the present disclosure.

It should be noted in FIG. 1 and FIG. 4 that the intake passage 31 and the exhaust passage 310 of the core body, and the intake shaft passage 21, and the exhaust shaft passage 210 are not corresponding according to the drawing rules, but for the sake of visual illustration, the intake passage and the exhaust passage of the core body in FIG. 1 do refer to the intake passage and the exhaust passage, and FIG. 6 and FIG. 9 in Embodiment 2 are shown similar to this.

Embodiment 2 refer to FIGS. 6-9, the pneumatic device includes two independent work units to form a two-stage driving structure, that is, two gas passages are provided on the core body 3 along the circumferential direction, and each gas passage includes one- or more-stage intake passage 31 and secondary stroke flow channel 300 and the core body 3 are provided with the exhaust passage 310 along the circumferential direction. The pneumatic device includes the outer ring 1, the inner ring surface of which is provided with a plurality of driving recesses 11 in the circumferential direction; the core body 3, being coaxially arranged in the outer ring 1 and being capable of rotating relative to the outer ring, where the outer ring surface of the core body is provided with two sets of nozzles and exhaust ports, and at least one secondary stroke flow channel provided between each set of nozzles and exhaust ports, the core body is provided with two intake passages 31, 32 communicating with corresponding nozzles, and two exhaust passages 310, 320 communicating with corresponding exhaust ports. Two gases enter from the two intake passages of the core body respectively, and are ejected in stages through the nozzles and the secondary stroke flow channel 300 of the core body 3, act on the corresponding driving recesses of the outer ring 11 in the circumferential direction, and generate a pushing force for the driving recesses to push the outer ring 1 to rotate and do work, so as to achieve a power output, and finally, the gas is discharged from the exhaust passage through the exhaust ports of the core body. The above-mentioned one intake passage, one nozzle, the corresponding number of driving recess and corresponding secondary stroke flow channel, exhaust port and one exhaust passage form an independent work unit.

The pneumatic device also includes a shaft 2, the outer ring 1 and the core 3 are coaxially arranged on the shaft, the shaft 2 is provided with intake shaft passages 21, 22 and exhaust shaft passages 210, 220, and the intake shaft passages 21, 22 and exhaust shaft passages 210, 220 communicate with the intake passages 31, 32 and the exhaust passages 310, 320 of the core body, respectively. The shaft 2 is provided with two inlets and two outlets corresponding to gas passages; compressed gas enters from the two inlets of the shaft 2, and is ejected through the intake passages of the core body 3 to act on the driving recesses 11 of the outer ring 1 to generate a pushing force to push the outer ring 1 to rotate and do work, and finally, the compressed gas arrives at corresponding outlets through the exhaust passages of the core body 3 to achieve a continuous power output. Other structures are the same as those in Embodiment 1, and will not be repeated.

Embodiment 3 the pneumatic device of the present disclosure includes 4 or more independent work units to form a multi-stage driving structure, and three or more gas passages are provided on the core body in the circumferential direction, and each gas passage includes one- or more-stage intake passage and secondary stroke flow channel, and the exhaust passages are arranged along the circumference direction of the core body, the intake passages and the exhaust passages are arranged on left and right mating surfaces of core body. The shaft is provided with intake shaft passages and exhaust shaft passages with the number corresponding to the gas passages. Compressed gas enters from the intake shaft passage of the shaft and is ejected through the intake flow channels of the core body to act on the driving recesses of the outer ring to push the outer ring to rotate and do work, so as to realize a continuous power output, and finally, the compressed gas arrives at a corresponding exhaust shaft passage through each exhaust passage of the core body. Other structures are the same as those in Embodiment 1.

Embodiment 4

Prototype of pneumatic device:

(1) two-stage pneumatic device

1. Main parameters are as follows:

(1) Gas pressure: 1.2 MPa;

(2) Maximum rotation speed: 8550 r/min;
(3) Number of stage of driving structure: 3;
(4) Diameter of intake flow channel: Φ5 mm;
(5) Number of stage of intake for single-stage driving: 2;
(6) Diameter of outer ring: Φ140 mm;
(7) Weight of outer ring: 2.5 KG
2. Torque output

| | |
|---|---|
| Static torque (rotation speed is 0 r/min) | N static = 4.95 N · m; |
| Output torque 1 (rotation speed is 1000 r/min) | N1000 = 6.23 N · m; |
| Output torque 2 (rotation speed is 3000 r/min) | N3000 = 8.79 N · m; |
| Output torque 3 (rotation speed is 5000 r/min) | N5000 = 11.35 N · m; |
| Output torque 4 (rotation speed is 8550 r/min) | Nmax = 15.89 N · m. |

(2) Five-stage pneumatic device
1. Main parameters are as follows:
(1) Gas pressure: 1.2 MPa;
(2) Maximum rotation speed: 17967 r/min;
(3) Number of stage of driving structure: 3;
(4) Diameter of intake flow channel: Φ5 mm;
(5) Number of stage of intake for single-stage driving: 5;
(6) Diameter of outer ring: Φ140 mm;
(7) Weight of outer ring: 2.5 KG.
2. Torque output

| | |
|---|---|
| Static torque (rotation speed is 0 r/min) | N static = 9.58 N · m; |
| Output torque 1 (rotation speed is 1000 r/min) | N1000 = 10.86 N · m; |
| Output torque 2 (rotation speed is 3000 r/min) | N3000 = 13.42 N · m; |
| Output torque 3 (rotation speed is 5000 r/min) | N5000 = 15.98 N · m; |
| Output torque 4 (rotation speed is 10000 r/min) | N10000 = 22.38 N · m; |
| Output torque 5 (rotation speed is 17967 r/min) | Nmax = 33.58 N · m. |

It can be seen from the experiments that under the same conditions, increasing the number of stage of driving intake can significantly increase the output torque, acceleration performance is better, and at the same time, it is also beneficial to increase the rotation speed.

The above records are only embodiments using the technical solution of the present disclosure; any modification and change made by use of the present disclosure by a person familiar with this art belong to the patent scope claimed by the present disclosure without limitation to those disclosures in the embodiments.

What is claim is:

1. A pneumatic device, comprising:

an outer ring, having at least two driving recesses on an inner ring surface of the outer ring in a circumferential direction;

a core body, being coaxially arranged in the outer ring and being capable of rotating relative to the outer ring, where an outer ring surface of the core body is provided with at least one nozzle and at least one exhaust port, and the core body is further provided with at least one secondary stroke flow channel between the at least one nozzle and the at least one exhaust port, wherein each secondary stroke flow channel is delimited by radially inner and outer boundaries, a portion of which are radially spaced from the outer ring surface of the core body, and includes a return channel and a stroke channel communicated with the return channel, at least one intake passage communicating with the at least one nozzle, and at least one exhaust passage communicating with the at least one exhaust port;

wherein the at least one intake passage terminates at the at least one nozzle on the outer ring surface of the core body, and wherein, for a rotational position of the core body relative to the outer ring:

the at least one nozzle communicates with a driving recess of the at least two driving recesses of the outer ring, and each secondary stroke flow channel communicates with two driving recesses of the at least two driving recesses, i.e., front and rear driving recesses, of the outer ring and forms a N-stage flow channel along the circumferential direction of the core body, where N is a natural number greater than or equal to 2, the return channel of a N-stage secondary stroke flow channel of the at least one secondary stroke flow channel communicates with a N-stage driving recess of the at least two driving recesses, and the stroke channel of the N-stage secondary stroke flow channel communicates with another N-stage driving recess of the at least two driving recesses;

wherein the N-stage flow channels are arranged in series to form a multi-stage stroke structure with decreasing energy of gas flowing therethrough;

wherein a running direction of the at least one intake passage is a logarithmic spiral line extending from a middle to an outside of the core body, and a running direction of each stroke channel is a portion of a logarithmic spiral line extending from the middle to the outside of the core body, wherein, in operation, the gas enters from the at least one intake passage and flows through the multi-stage stroke structure to generate a pushing force that causes the outer ring to rotate and do work, so as to achieve a power output, and finally, the gas is discharged from the at least one exhaust passage through the at least one exhaust port of the core body.

2. The pneumatic device according to claim 1, further comprising at least one independent work unit, wherein each independent work unit includes: one of the at least one intake passage, one of the at least one nozzle, at least two of the driving recesses, at least one of the at least one secondary stroke flow channel, one of the at least one exhaust port and one of the at least one exhaust passage.

3. The pneumatic device according to claim 1, wherein each secondary stroke flow channel is arranged along the core body in the circumferential direction.

4. The pneumatic device according to claim 1, wherein the at least one intake passage and the at least one exhaust passage are formed inside the core body.

5. The pneumatic device according to claim 4, wherein a running direction of each return channel is an arc line extending inward from the outer ring surface of the core body.

6. The pneumatic device according to claim 4, wherein a pole of the logarithmic spiral line of the at least one intake passage is set on a central axis line of the core body.

7. The pneumatic device according to claim 1, wherein the pneumatic device further comprises a shaft, and the core body is coaxially arranged on the shaft.

8. The pneumatic device according to claim 7, wherein the shaft is provided with an intake shaft passage and an exhaust shaft passage, which are in communication with the at least one intake passage and the at least one exhaust passage of the core body, respectively.

9. The pneumatic device according to claim 8, wherein the intake shaft passage and the exhaust shaft passage in the shaft are provided with an inlet and an outlet, respectively.

10. The pneumatic device according to claim 9, wherein the inlet and outlet of the shaft are arranged at one end of the shaft or at two ends of the shaft, and the outlet of the shaft axially extends to form the at least one exhaust shaft passage.

11. The pneumatic device according to claim 7, wherein the outer ring is connected to the shaft through side plates to form a closed space, and the core body is arranged in the closed space and connected and fixed with the shaft.

12. The pneumatic device according to claim 1, wherein each driving recess has a contour bottom surface and a driving surface, and a contour line of each contour bottom surface is a portion of a logarithmic spiral line having a pole set at a center of the core body.

13. The pneumatic device according to claim 1, wherein the core body is formed by a left core body and a right core body matching with each other, and matching surfaces of the left and right core bodies are provided with the at least one intake passage and the at least one exhaust passage.

* * * * *